United States Patent [19]

Moulds et al.

[11] 4,189,898

[45] Feb. 26, 1980

[54] EGG PACKER

[75] Inventors: Frank G. Moulds, Livonia; Michael A. McCord, Wayne, both of Mich.

[73] Assignee: Diamond International Corporation, New York, N.Y.

[21] Appl. No.: 920,462

[22] Filed: Jun. 29, 1978

[51] Int. Cl.[2] ..... B65B 35/56

[52] U.S. Cl. ..... 53/446; 53/473; 53/534; 53/544; 53/143

[58] Field of Search ..... 53/446, 473, 475, 534, 53/143, 246, 260, 544

[56] References Cited

U.S. PATENT DOCUMENTS

| | | | |
|---|---|---|---|
| 3,311,216 | 3/1967 | Jones | 53/534 X |
| 3,964,233 | 6/1976 | Thomas | 53/534 X |

*Primary Examiner*—Travis S. McGehee
*Attorney, Agent, or Firm*—Kenyon & Kenyon

[57] ABSTRACT

An egg packer in which the eggs are aligned while being conveyed to a transfer position with the eggs thereat having their narrow ends in an abutting relation with a transversely disposed vertical wall. A receptacle is disposed adjacent the end of the conveyor into which the eggs are guided with the larger end of the egg first entering into the receptacle. Upon rotation of the receptacle, the egg is turned and assumes a position with the narrow end facing downwardly. A pair of shell members receive the egg and move it into alignment with the egg carton or other receiving means at which the shell members are opened and the egg is deposited with the narrow end thereof downwardly facing.

12 Claims, 7 Drawing Figures

EGG PACKER

BACKGROUND OF THE INVENTION

This invention relates generally to egg handling equipment and more particularly to means for orienting an egg to be packed within a receptacle.

It is generally known in the egg processing industry that a greater storage life is achieved when eggs are packed and stored with their narrow end facing downward. Various machines have been devised in order to accomplish such at packaging. Included among these packing machines is the one described in the earlier patent of Leslie P. Thomas, U.S. Pat. No. 3,964,233 issued on June 22, 1976, which is also assigned to the assignee of this invention. Therein, the eggs are carried along an upwardly inclined conveyor which includes a plurality of rotating rollers. The rolling action causes the eggs to assume a position with their narrower ends in abutment with a wall disposed transverse to the longitudinal axis of the rollers. At the end of the conveyor a spring mounted plow or guide tongue 41 is positioned. The plows 41 are centrally located in relation to the pair of channel walls and cause the egg to turn as it is about to go over the top of the endless conveyor. The plow thus retards the large end of the egg causing it to pass down into a retainer with its narrow end downwardly facing. The thus oriented egg is then dropped into a clam shell transfer means which shuttles the egg between the retainer and the receiving bucket disposed therebelow. The clam shell moves so as to adjust the horizontal spacing between the eggs during their descent into the receiving buckets.

Various other orienting means have also been provided for use in conjunction with an egg conveying apparatus. In general, all of these prior art systems provide a means for engaging the egg as it is being transferred from the conveyor into a packing carton or the like. Although these systems have been generally effective, the applicant has discovered a simplified means for accomplishing orientation and transfer of the egg from a conveyor into a packaging carton or the like. In accordance with the applicant's apparatus and method, the transfer is accomplished rapidly and accurately without any undue number of component parts such as is the case with certain of the prior art systems.

SUMMARY OF THE INVENTION

Briefly stated, the apparatus of the present invention includes an endless conveyor formed by a plurality of spaced rollers adapted to receive and convey eggs positioned therebetween. A pair of spaced abutment members are disposed transverse to the axis of rotation of the rollers such that upon conveyance of the eggs they are rotated and caused to move towards one of the abutment members with the egg assuming a position having its narrower end in abutting relationship therewith. Disposed adjacent the endless conveyor is a receptacle suitable for receiving an egg as it approaches the end of the conveyor. The receptacle is pivotally mounted and includes side walls inclined towards one another for guiding the egg into the receptacle with the larger end of the egg being positioned within the bottom portion of the receptacle. The apparatus further includes a means for rotating the receptacle so as to turn the egg into a position with its narrow end downwardly facing so that it may be so positioned within the transportable receiving means.

The receptacle means includes a plurality of cups adapted to receive an egg disposed adjacent the endless conveyor. The plurality of cups are mounted on a common rotatable shaft and suitably spaced from one another. The cups include a pair of side guide walls which have the egg contacting surfaces thereof concavely curved with the upper portions of the walls being spaced from one another along the longitudinal axis of the rotatable shaft. The cup is provided with an opening at the top or initial egg receiving end which is wider than the opening at the bottom of the portion of the cup. The cup is mounted on the rotatable shaft by means of ears extending from the lower portion thereof and which have an aperture therein adapted for mounting on the rotatable shaft. Between each of the ears is included a spacer means which allows for fixing the cup to the shaft so that each of the cups rotates in alignment along with the shaft.

In practicing the method of the invention, the eggs are rotated along movable rollers provided on an endless chain conveyor which causes the narrow end of the egg to take a position in engagement with an abutment means disposed transverse to the longitudinal axis of the rollers. The egg is conveyed to the end of the conveyor at which time it is rolled from the conveyor without any external force being applied thereto. The egg in this manner is rotated with its larger end coming off the conveyor first and being received in a receptacle disposed adjacent the conveyor. Rotating the receptacle causes the egg to turn and assume a position with its narrow end pointed in a downward direction. After rotation, the egg is transferred into a transportable receiver means or carton.

Also included within the method of the invention is the further step of moving the rotated egg with its pointed end downwardly facing from the receptacle into a pair of movable shell members. The shell members are adapted to position the egg for reception in the transportable receiving means or carton with the narrow end pointing downwardly. Also included within the method of the invention is the step of sliding the egg along an inclined wall of the receptacle with the egg thus being positioned with its wider end facing the bottom of the receptacle.

Accordingly, it is an object of this invention to provide an egg orienting apparatus and method which effectively transfers and orients an egg.

It is another object of this invention to provide an egg orienting means wherein the egg is transferred from an endless conveyor into a position with its narrow end downwardly facing so as to be received within a carton or the like.

It is a further object of this invention to accomplish the transfer of an egg from a conveyor to a receptacle without exerting any external force on the egg.

These and other objects, advantages and features of the invention will become more apparent from the following description taken in conjunction with the accompanying drawings.

BRIEF DESCRIPTION OF THE DRAWINGS

FIG. 3 is a partial elevation view depicting the manner in which the egg is rotated and transferred into the egg receiving carton.

DESCRIPTION OF THE PREFERRED EMBODIMENT

Figure 1:
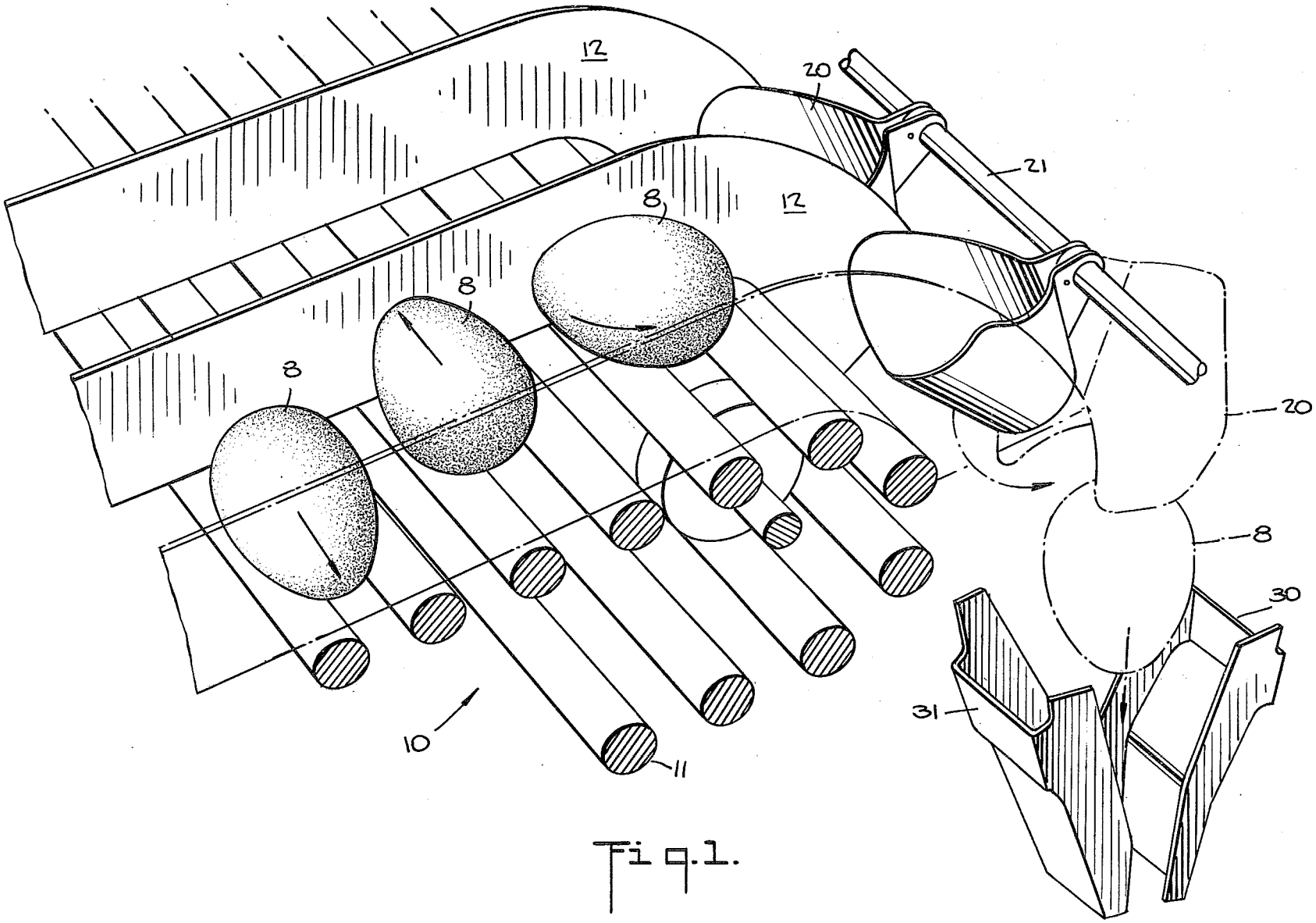
FIG. 1 is a partial perspective view depicting the manner in which the eggs are transferred from the conveyor and oriented for packaging.
Figure 2:
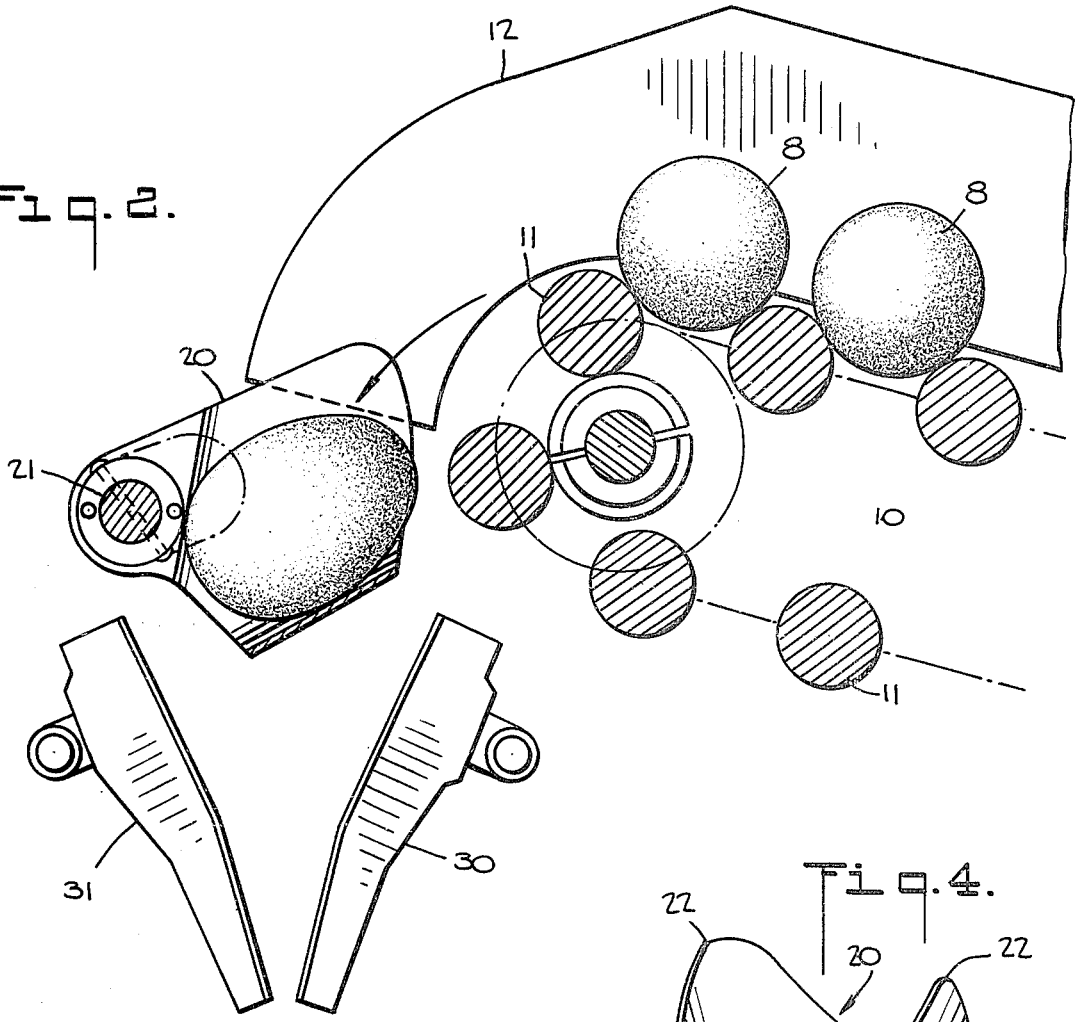
FIG. 2 is a partial elevation view depicting the transfer of an egg into a receptacle disposed adjacent the conveyor.

With reference to the drawings, the eggs 8 are moved from a reservoir onto a conveyor depicted generally as 10. The conveyor 10 includes a plurality of rotatable rollers 11 which form an endless chain. The rollers are driven by a rack and pinion drive such as disclosed in the afore-referenced U.S. Pat. No. 3,964,233 or by any other suitable means. A wall 12 is disposed along the upper portion of the endless conveyor 10 and spaced slightly above the top portion of roller 11. The end portion of wall 12 conforms to the shape of the endless conveyor 10 and thus curves downwardly at the end portion thereof. In this manner the eggs are moved the length of the conveyor 10 and rotated such that the narrow end portion of the egg assumes an abutting relation with the wall 12.

Figure 4:
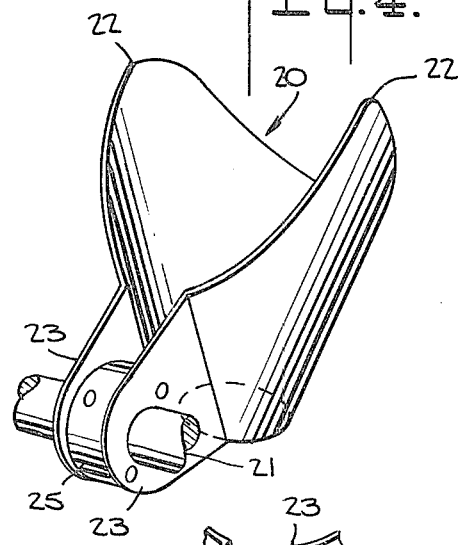
FIG. 4 is a perspective view of the egg receiving receptacle mounted on the rotatable shaft.
Figure 5:
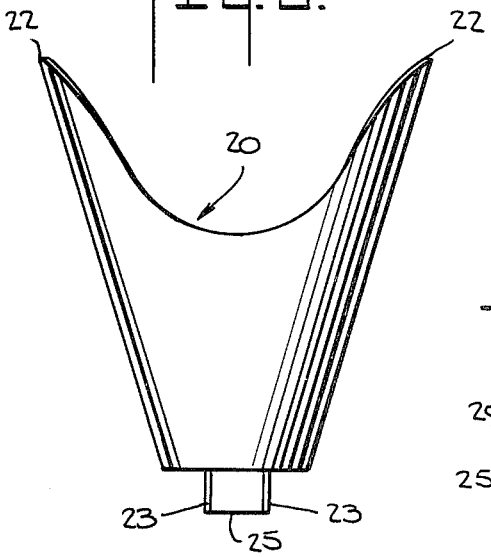
FIG. 5 is an end elevation view of the egg receiving receptacle.
Figure 6:
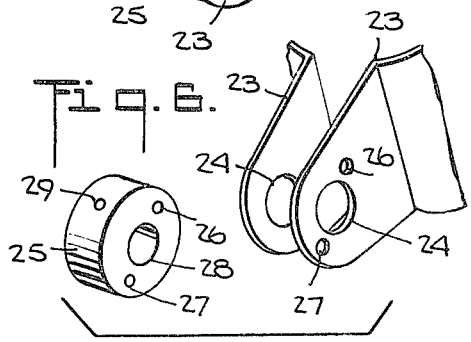
FIG. 6 is an exploded view depicting the shaft mounting portion of the egg receiving receptacle and the spacer member.
Figure 8:
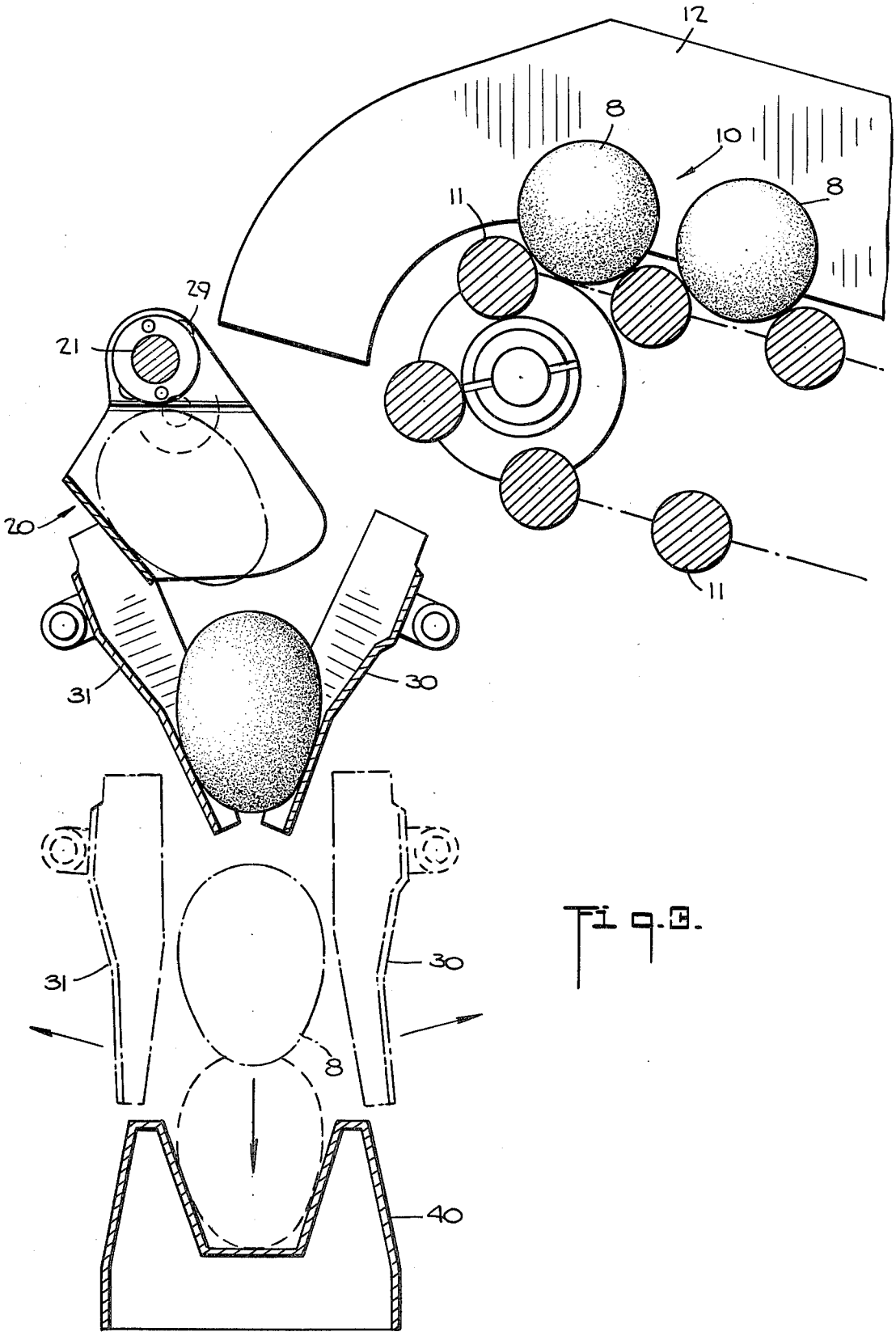
Figure 7:
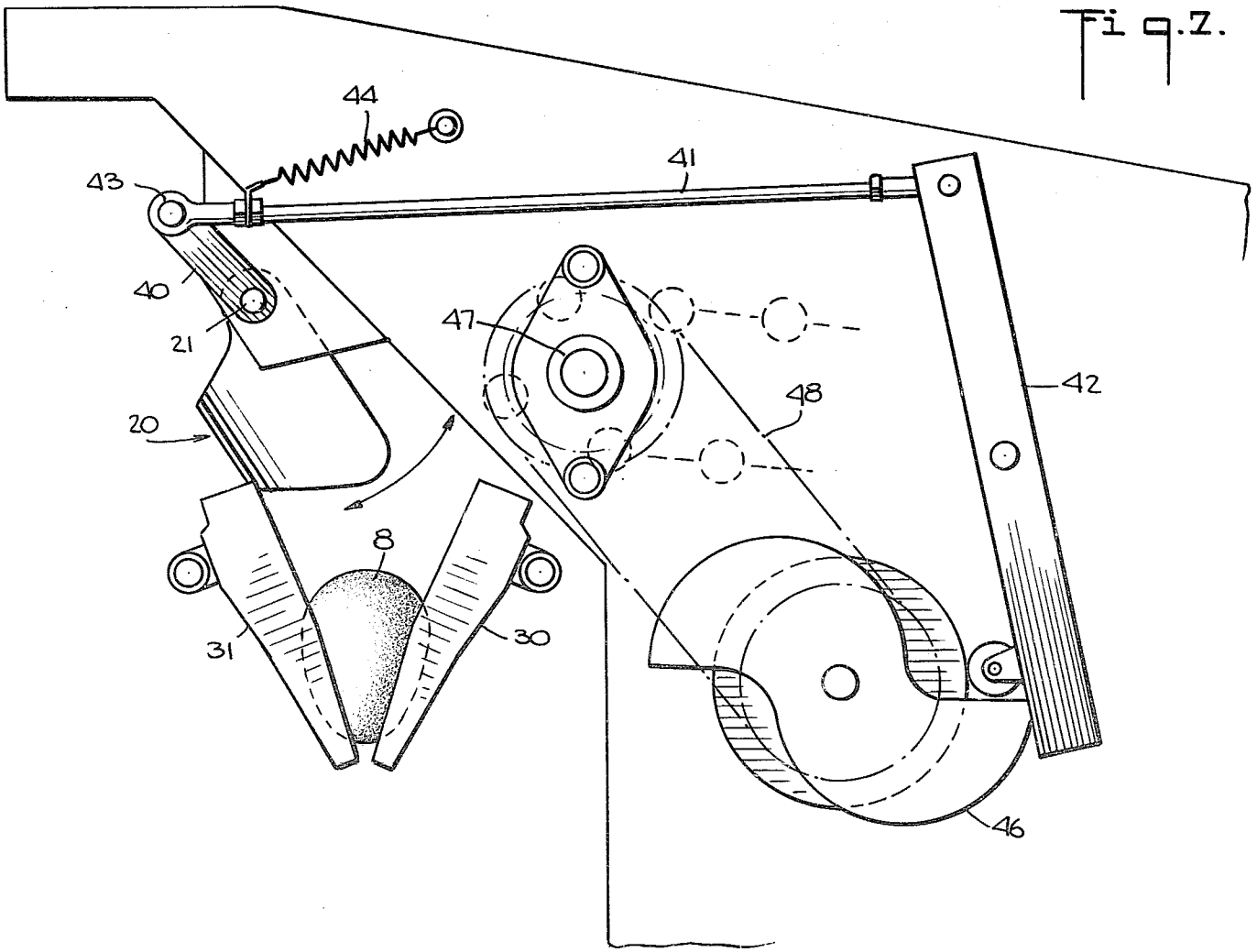
FIG. 7 is a side elevation view depicting the rotatable shaft drive mechanism.

Adjacent the end of conveyor 10 is disposed a receptacle 20 suitable for receiving the egg being discharged off the conveyor. Receptacle 20 is mounted on a rotatable shaft 21 and has a cup-like shape (FIG. 4). The cup shaped receptacle includes upwardly extending inclined side walls 22 which have the egg receiving sides thereof concavely curved. The overall width of the cup, i.e., the distance between the uppermost portions of side walls 22, is slightly less than the distance between adjacently spaced walls 12. The portion of the cup connecting walls 22 is of a lesser height than side walls 22. Extending from the lower portion of the cup are a pair of ears 23 each of which has an aperture 24 therein to facilitate mounting of receptacle 20 on the shaft 21. A spacer 25, preferably made of an elastomer, is disposed between the ears and fastened thereto by screws at 26 and 27. The spacer 25 also includes a hole 28 through the center thereof to allow for mounting on rotatable shaft 21. The receptacle assembly is held in position on the shaft 21 by means of a pin 29 which passes through spacer 25 into engagement with shaft 21.

Shaft 21 is driven by means of the conveyor drive motor to allow its timing to be maintained in synchronism therewith. In this connection, shaft 21 has its rotational movement controlled by a three bar linkage comprised of members 40, 41 and 42. Linkage 40 is fixedly mounted at one end thereof to rotate with shaft 21 while the other end thereof is pivotally mounted with respect to linkage 41 via coupling 43. A spring member 44 which is connected to linkage 41 urges the receptacle cup 20 toward the conveyor assembly. The remaining linkage 42 includes a cam follower 45 at one end thereof, with the linkage thus being actuated by driven cam 46. Cam 46 is driven by the conveyor drive motor shaft 47 via the chain and sprocket drive 48. Because the motor driven shaft 47 also rotates the rotating rollers 11 that align the eggs, the receptacle cup 20 is rotated in synchronism therewith via the action of the cam and three bar linkage.

Disposed beneath each receptacle 20 are movable clam shell members 30 ad 31. The clam shell members are of the same type and operate in the same manner as those described in U.S. Pat. No. 3,964,233. To summarize, each of the clam shell assemblies are draw-link connected to one another and adapted to receive the eggs from receptacle 20. Beneath receptacle 20, the clam shell assemblies are spaced from one another at a fixed center to center spacing X. In that the center to center spacing of the carton 40 or egg receiving means is different and smaller than X, the clam shell assemblies are moved laterally. Thus, as the shell assemblies descend toward the egg carton 40 disposed therebeneath, the shell assemblies are moved towards one another to accommodate the difference in lateral spacing of the receptacle 20 and carton 40. The means for accomplishing this operation is fully described in U.S. Pat. No. 3,964,233 which is incorporated herein by reference.

The operation of the egg packer of this invention is described as follows. Eggs 8 are moved from a reservoir onto the endless conveyor 10. Rotating rollers 11 cause the eggs to assume an abutting relationship with one of the vertical walls 12. More specifically, as shown in FIG. 1 the narrow end of the egg 8 engages or abuts with one of the vertical walls 12. As the egg approaches the end of conveyor 10, the rotational movement and the weight of the egg causes the larger end to leave the conveyor first. The egg thus falls into receptacles 20 with one of the inclined side walls 22 engaging the egg and guiding the larger end into the bottom of the receptacle. With the egg in place, receptacle 20 is then rotated in a downward direction approximately 80 degrees. Once the egg has been fully turned it slides along the wall of clam shell 30 which with the other member 31 is in the closed position. The egg then slides to the bottom of the closed clam shell assembly which means of the draw-link mechanism previously discussed, changes the lateral spacing between the eggs and lowers them into the carton or tray 40. The egg is thus packed with its narrow end facing down in the carton or other transportable receiving means. Accordingly, the method and apparatus of this invention have proven to be highly effective and uses a simplified transfer mechanism without any external force being necessary to align the egg.

Although the above description is directed to a preferred embodiment of the invention, it is noted that other variations and modifications will be apparent to those skilled in the art and, therefore, may be made without departing from the spirit and scope of the present disclosure.

What is claimed is:

1. An apparatus for orienting and transferring eggs to a transportable receiving means which comprises an endless conveyor including a plurality of spaced rollers adapted for receiving eggs therebetween, a pair of spaced abutment members disposed transverse to the axis of rotation of said rollers, means for rotating said rollers so as to cause the eggs carried between said rollers to move towards one of said abutment members with the narrower end of the egg in a substantially abutting relation therewith, receptacle means disposed adjacent said endless conveyor for receiving the egg carried on said conveyor, said receptacle means being pivotally mounted and having side guide walls for receiving the egg transferred from said conveyor with the larger end of the egg being guided toward the bottom of said receptacle, said side guide walls being inclined towards one another so that the initial egg receiving end of said receptacle means is of a greater width than the bottom portion thereof, means for rotating said receptacle means so as to turn the egg into a position with the narrow end being downward facing, and transportable receiving means disposed beneath said receptacle means into which the eggs are deposited and oriented with the narrow end thereof facing in the downward direction.

2. An apparatus in accordance with claim 1 which further includes a pair of movable shells disposed beneath said receptacle, said shells being adapted to move the egg from said receptacle means to said transportable receiving means and assume a closed position upon receiving the egg and an open position at the point of depositing the egg in said transportable receiving means.

3. An apparatus in accordance with claim 1 wherein said endless conveyor is inclined upwardly with the end from which eggs are removed being higher than the end at which the eggs are received.

4. An apparatus in accordance with claim 1 wherein said receptacle means include a plurality of cups disposed adjacent said endless conveyor each of which is adapted to receive an egg, and a common rotatable shaft upon which each of said cups is mounted.

5. An apparatus in accordance with claim 4 wherein each of said cups is provided with a pair of side guide walls which extend above the remainder of said cup, said guide walls having the egg contacting surfaces thereof concavely curved with the upper portions of said walls being spaced from one another along the longitudinal axis of said rotatable shaft.

6. An apparatus in accordance with claim 4 wherein said cup shaped receptacle is open ended at its top and bottom, the opening at the top being larger than that at the bottom.

7. An apparatus in accordance with claim 4 wherein said cup shaped receptacle includes a pair of ears extending from the lower portion thereof, said ears having therein a hole suitable for mounting on said rotational shaft.

8. An apparatus in accordance with claim 7 which further includes a spacer means disposed between said ears extending from said cup shaped receptacle, said spacer means including means for fixedly mating said spacer with said rotational shaft so that said cup shaped receptacle rotates along with said shaft.

9. An apparatus in accordance with claim 5 wherein the spacing of said upper portions of said guide walls is slightly less than the spacing between said abutment members.

10. A method of transferring eggs from a conveyor which includes an endless chain of rollers to a transportable receiving means which comprises rotating the eggs along movable rollers of the endless chain conveyor while advancing the eggs thereon to cause the narrower end of the eggs to take a position in engagement with an abutment means disposed transverse to the longitudinal axis of the rollers and to cause the eggs to roll off the endless conveyor otherwise unassisted, the larger end of the falling eggs leading, disposing an egg catching receptacle adjacent the endless chain in a position to receive an egg which falls from the rollers, receiving a falling egg in the receptacle with the larger end being received first in the receptacle, rotating the receptacle to turn the received egg into a position with its narrow end oriented in a downward direction, and transferring the egg from the receptacle with its narrow end downwardly facing into a transportable receiving means.

11. The method of claim 10 which further includes the step of moving the rotated egg with its narrow end downwardly facing from said receptacle into a pair of movable shell members suitable for transporting said egg to said transportable receiving means, and opening said shell members so as to release and deposit the egg with its narrow end downwardly facing into said transportable receiving means.

12. The method of claim 10 wherein said step of receiving said egg in said receptacle includes the step of sliding the egg along an inclined wall of said receptacle with the egg assuming a position within said receptacle with the larger end extending into the bottom of said receptacle.

* * * * *